US010151169B2

(12) United States Patent
Dedman et al.

(10) Patent No.: US 10,151,169 B2
(45) Date of Patent: Dec. 11, 2018

(54) DUAL BARRIER PUMP-OUT PLUG

(71) Applicant: Weatherford Technology Holdings, LLC, Houston, TX (US)

(72) Inventors: Michael Dedman, Powell, WY (US); Cornelis C. Valkenburg, Powell, WY (US)

(73) Assignee: Weatherford Technology Holdings, LLC, Houston, TX (US)

( * ) Notice: Subject to any disclaimer, the term of this patent is extended or adjusted under 35 U.S.C. 154(b) by 219 days.

(21) Appl. No.: 15/155,230

(22) Filed: May 16, 2016

(65) Prior Publication Data

US 2016/0333660 A1 Nov. 17, 2016

Related U.S. Application Data

(60) Provisional application No. 62/162,182, filed on May 15, 2015.

(51) Int. Cl.
*E21B 33/12* (2006.01)

(52) U.S. Cl.
CPC ..... *E21B 33/1208* (2013.01); *E21B 33/12* (2013.01)

(58) Field of Classification Search
CPC ..... E21B 33/12; E21B 33/1208; E21B 33/124
See application file for complete search history.

(56) References Cited

U.S. PATENT DOCUMENTS 5,890,537 A * 4/1999 Lavaure ..... E21B 33/16 166/156
6,026,903 A 2/2000 Shy et al.
6,076,600 A 6/2000 Vick, Jr. et al.
7,963,340 B2 6/2011 Gramstad et al.

OTHER PUBLICATIONS

Halliburton, "Mirage® Disappearing Plug and Autofill Sub," Brochure, copyright 2010, dated Jun. 2010, 2-pgs.
Wireline Solutions, "Hydro Trip Pressure Subs," Brochure, undated, obtained from www.f-e-t.com/images/uploads/Hydro_Trip_Subs.pdf on Mar. 24, 2015, 5-pgs.
Owen Oil Tools, "Single Magnumdisk," Brochure, copyright 2007, revised Sep. 2012, 2-pgs.
Halliburton, "Mirage® NG Disappearing Plug," Brochure, undated, obtained from www.halliburton.com on Mar. 24, 2015, 5-pgs.
(Continued)

*Primary Examiner* — Brad Harcourt
(74) *Attorney, Agent, or Firm* — Blank Rome LLP

(57) ABSTRACT

Wellbore isolation is used for a tubing string in a well. A first plug is held by a first temporary retention in a bore of a housing disposed on the tubing string and is sealed in the bore with a first seal. A second plug is also held in the bore by a second temporary retention and is sealed in the bore with a second seal. The first and second seals seal a space in the bore between the plugs. Both plugs can be of a dissolvable material. An uphole end of the first plug facing away from the space can have a non-dissolvable coating, while a downhole end of the second plug facing away from the space can have a non-dissolvable coating. The first plug releases in the bore when an uphole pressure is applied in the tubing string, and the second plug then releases after the first plug.

27 Claims, 4 Drawing Sheets

(56) References Cited

OTHER PUBLICATIONS

Schlumberger, "Model A and Model B Pumpout Plugs," Brochure, copyright 2008, 1-pg.
Schlumberger, "PE-500 Pumpout Plug," Brochure, copyright 2008, 1-pg.
Lufkin, "Pump Out Plug," web page at http://www.lufkin.com/index.php/products-a-services/oilfield/completion-equipment/tubing-and-packer-accessories/pump-out-plug obtained Mar. 23, 2015, copyright 2013, 1-pg.

* cited by examiner (Background)

DUAL BARRIER PUMP-OUT PLUG

CROSS-REFERENCE TO RELATED APPLICATIONS

This application claims the benefit of U.S. Provisional Appl. 62/162,182, filed 15 May 2015, which is incorporated herein by reference.

BACKGROUND OF THE DISCLOSURE

In a production well, a production string composed of production tubing and other completion components transports production fluid from a downhole formation to the surface of the well. The production tubing is typically pressure tested to insure that no leaks will form under the pressure of actual production. It is desirable to find leaks before production fluid is introduced into the tubing because post-production repairs are grossly inefficient.

Typically, a temporary well barrier, or temporary plug, is used to seal off a particular segment or zone of the production tubing for pressure testing. Often, the well zone for pressure testing consists of essentially the entire tubing string. Fluid is then introduced above the temporary well barrier and pressurized to detect leaks in the production tubing.

In addition to testing for leaks, temporary well barriers can be used to set various types of hydraulically-activated tools on the tubing string. In this case, the barriers plug the tubing string to hold fluid pressure, which can then be applied to the hydraulically-activated tools. Either way, after testing or setting, the temporary well barriers must be removed from the production string so production can proceed.

As background to the present disclosure, FIG. 1A shows a tubing string 12 disposed in a well 10. A temporary well barrier 30 on the tubing string 12 can be used to test for leaks or to set hydraulically-set tools, such as packers 16, sleeves 18, and the like, on the string 12. The temporary well barrier 30 provides a temporary obstruction so that hydraulic pressure applied down the tubing string 12 from a pump system 25 at the rig 20 can be prevented from communicating further downhole.

In FIG. 1A, the barrier 30 is disposed at the toe of the tubing string 12, but this is not strictly necessary. Various barriers 30 can be disposed elsewhere along the tubing string 12. In fact, because temporary well barriers can be used to activate tools on the tubing string 12 with applied pressures, one or more barriers 30 can be disposed directly downhole from a hydraulically-set tool, such as a packer 16 or the like.

Several types of temporary well barriers can be used to test the tubing or to set hydraulic-set tools on the tubing string. Some of these prior art barriers include the Model WE Hydro Trip pressure sub by Baker Oil Tools, the OCRE Full Bore Isolation Valve and Multi-Cycle Tool by Baker Oil Tools, and the Mirage Disappearing Plug from Halliburton.

Some temporary well barriers use valves to control well flow, while others use dropped balls, frangible barriers, or other features. One type of temporary well barrier typical of the prior art includes a solid barrier held in place by a support assembly. To remove the barrier, the support assembly is retracted or sheared off to allow the solid barrier to drop through the wellbore. Once the temporary well barrier is removed, it is often desirable that substantially the full inner diameter of the production tubing is restored.

As one example, FIG. 1B shows a prior art well barrier 30 having a seat 34 temporarily held by shear pins 36 in a housing 32, which couples at its uphole end to tubing string (not shown). A dropped ball B engages the seat 34 to close off fluid pressure uphole. At a predetermined pressure, the seat 34 can be sheared free to open fluid communication and remove the temporary obstruction. This design may have limited use and may not be best suited for a horizontal wellbore.

To extend well-isolation to horizontal wells, temporary well barriers have been developed that provide a large bore after removal of the temporary obstruction without dropping the temporary obstruction into the wellbore. These temporary well barriers are broadly referred to as disappearing plugs. One type of disappearing plug operates by recessing the temporary obstruction into the housing of the device.

One disappearing plug from Baker Oil Tools, for example, recesses a flapper into the device where the flapper is then isolated from the production flow path. Other disappearing plugs operate by disintegrating a frangible well barrier, typically by impacting the barrier or setting off an explosive charge. Total Catcher Offshore AS in Bergen has developed several temporary well barriers employing this type of plug, such as the Tubing Disappearing Plug (TDP), the Tubing Disappearing Smart Plug (TDSP), and the Intervention Disappearing Smart Plug (IDSP).

For example, FIG. 1C shows a prior art temporary well barrier 30 having a frangible barrier 38 held in a housing 32 of the device 30. The frangible barrier 38 can provide isolation in both directions. Increased uphole pressure to a threshold or impact from above by an object (not shown) can break the frangible barrier 38 and open fluid communication through the housing 32.

U.S. Pat. No. 6,076,600 describes a plug apparatus having a dispersible plug member and a fluid barrier. In another example, U.S. Pat. No. 6,026,903 describes a bidirectional disappearing plug which is capable of selectively blocking flow through a flowbore of a tubing string disposed within a subterranean well. The plug may subsequently be disposed of, leaving little or no restriction to flow through the flowbore, and leaving no significant debris in the flowbore by causing a rupture sleeve to penetrate the plug member and destroy the plug's integrity.

Although the various temporary well barriers available in the art can be effective, operators are continually seeking temporary well barriers that can meet the various needs found in wells. The subject matter of the present disclosure is directed to overcoming, or at least reducing the effects of, one or more of the problems set forth above.

SUMMARY OF THE DISCLOSURE

According to the present disclosure, a wellbore isolation device for a tubing string in a well comprises a housing, a first plug, and a second plug. The housing is disposed on the tubing string and defines a bore therethrough. The housing can be disposed on an end of the tubing string, can be disposed downhole of a hydraulically-actuated tool, or can be integrated as part of the hydraulically-actuated tool.

The first plug is held in the bore by a first temporary retention and is sealed in the bore with a first seal. The second plug is held by a second temporary retention in the bore at a space from the first plug, and the second plug is sealed in the bore with a second seal. The first and second seals seal the space in the bore between the first and second plug elements.

The first temporary retention can use one or more shear pins engaging adjacent the first plug and the bore. For example, a first retention ring can be disposed in the bore around the first plug. The first retention ring can engage the one or more shear pins disposed in the first plug and can be held longitudinally in the bore by coupling of the housing to the tubing string. Additionally, a shoulder on the first ring can engage the first plug and can retain the first plug longitudinally in an uphole direction in the bore.

For this arrangement, the first seal can use a pair of the first seal elements disposed on both sides of the first retention ring. One of the first seal elements can seal between the bore and the first retention ring, while another of the first seal element can seal between the first retention ring and the first plug.

In a similar manner, the second temporary retention can use one or more shear pins disposed adjacent the second plug and the bore. For example, a second retention ring can be disposed in the bore around the second plug. The second ring can engage the one or more shear pins disposed in the second plug and can be held longitudinally in the bore by interconnected components of the housing. One of the interconnected components of the housing can have a shoulder engaging the second plug and retaining the second plug longitudinally in an uphole direction in the bore. Also, a pair of second seal elements disposed on both sides of the second retention ring and seal between the bore and the second ring and between the second ring and the second plug.

The first seal can comprises one or more O-ring seals disposed externally about the first plug and sealing against the bore of the housing. Likewise, the second seal can comprise one or more O-ring seals disposed externally about the second plug and sealing against the bore of the housing.

The first plug can comprise a dissolvable material, and an uphole end of the first plug facing away from the space can comprise a non-dissolvable surface or coating. For its part, the second plug can also comprises a dissolvable material. However, a downhole end of the second plug facing away from the space can comprise a non-dissolvable surface or coating.

The first temporary retention releases the first plug in the bore in response to application of an uphole pressure in the tubing string. After the release of the first plug, the second temporary retention releases the second plug in the bore in response to the application of the uphole pressure.

According to the present disclosure, a method of isolating portion of a tubing string in a well comprises not necessarily in sequence: configuring first and second plugs of dissolvable material; configuring at least one side of the first plug with non-dissolvable material; temporarily retaining the first plug sealed in a bore of a housing for deploying on the tubing string downhole in the well; temporarily retaining the second plug sealed in the bore of the housing at a space from the first plug and with the at least one first side of the first plug exposed to the bore outside the space; and configuring the temporary retention of the first and second plugs to release from the housing at least in response to an application of fluid pressure against the at least one first side of the first plug.

According to the present disclosure, a method of isolating portion of a tubing string in a well comprises not necessarily in sequence: deploying a housing on the tubing string downhole in the well; preventing fluid in the tubing string from dissolving a first dissolvable plug sealed in the housing with a non-dissolvable coating on at least one first side of the first dissolvable plug exposed to the tubing string; preventing the fluid in the tubing string from dissolving a second dissolvable plug sealed in the housing at a space downhole from the first dissolvable plug; preventing at least temporarily displacement of the first and second dissolvable plugs in the bore; and releasing the first and second plugs to displace in the housing by applying uphole fluid pressure against the at least one side of the first plug.

The foregoing summary is not intended to summarize each potential embodiment or every aspect of the present disclosure.

DETAILED DESCRIPTION OF THE DISCLOSURE

Figure 1A:
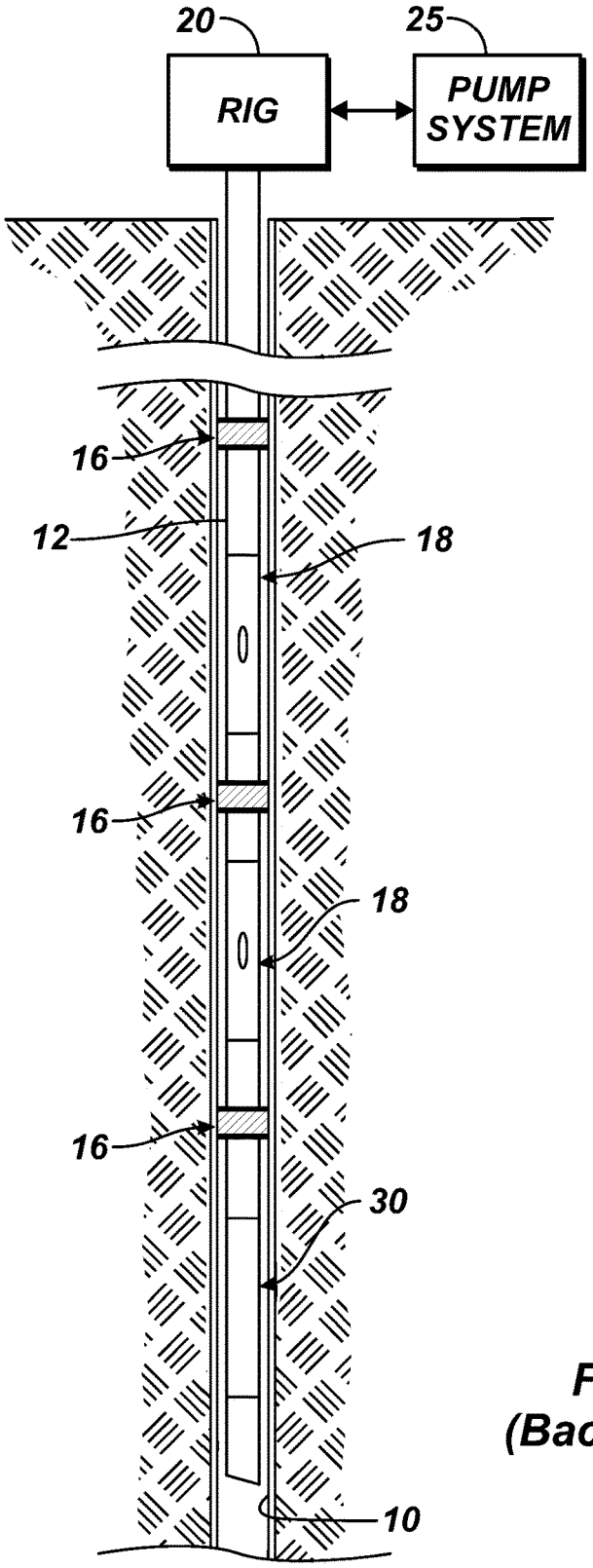
FIG. 1A illustrates a tubing string disposed in a well and having a temporary well barrier as background to the present disclosure.
Figure 1B:
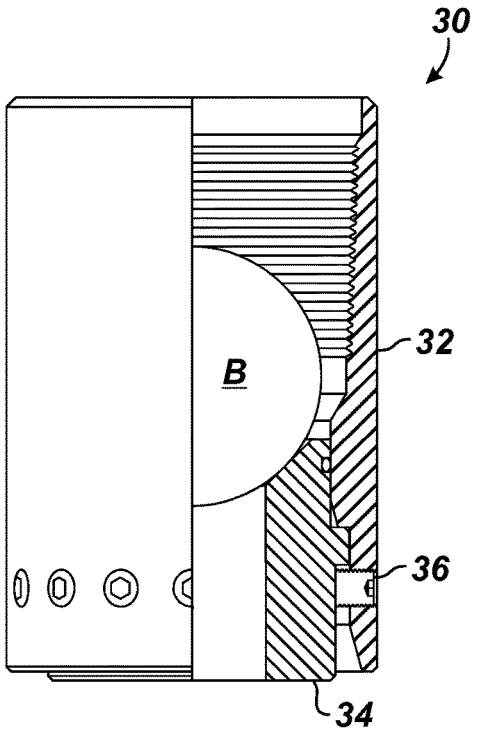
FIG. 1B (Prior Art)
FIG. 1B illustrates a temporary well barrier of the prior art having a shearable seat.
Figure 1C:
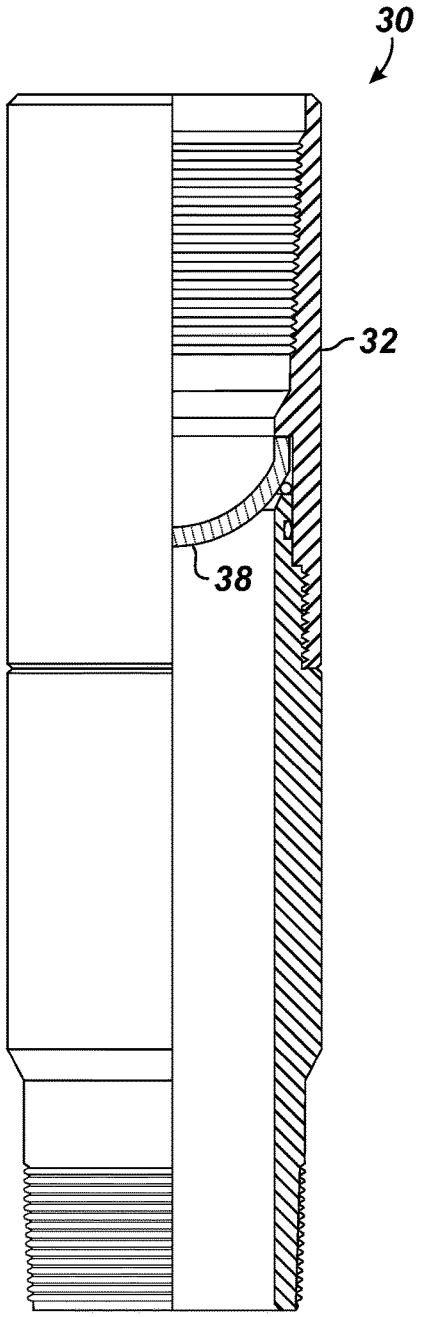
FIG. 1C (Prior Art)
FIG. 1C illustrates a temporary well barrier of the prior art having a frangible barrier.
Figure 2:
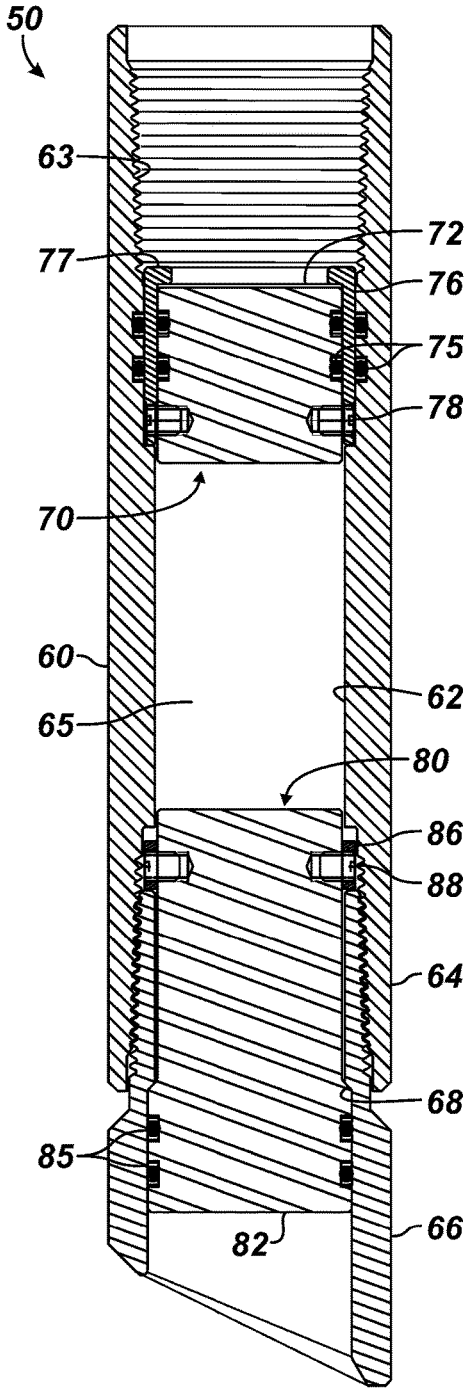
FIG. 2 illustrates a cross-sectional view of a dual-barrier wellbore isolation device according to the present disclosure.

As shown in cross-section in FIG. 2, a wellbore isolation device 50 for a tubing string (not shown) offers a dual temporary barrier. The device 50 includes a housing 60 and at least two plug elements or barriers 70, 80. The housing 60 can couple to the tubing string (not shown) at an uphole end 63 of the housing 60 using box thread or the like. The downhole end of the housing 60 may couple to additional components of the tubing string. Alternatively as shown here, the housing 60 may instead be used as the distal toe of a tubing string assembly. In fact, the housing 60 may have a tailpiece 66 with a wireline reentry guide shoe.

The housing 60 defines a bore 62 therethrough with the first and second plug elements 70, 80 disposed therein. The first plug element 70 is held in the bore 62 by a first temporary retention (e.g., 76, 78, etc.) and is sealed in the bore 62 with a first seal arrangement (e.g., 75). The second plug element 80 is disposed in the bore 62 a space 65 from the first plug element 70. In a similar manner to the first plug element 70, the second plug element 80 is held in the bore 62 by a second temporary retention (e.g., 86, 88, etc.) and is sealed in the bore 62 with a second seal arrangement (e.g., 85). The first and second seals 75, 78 seal the space 65 in the bore 62 between the first and second plug elements 70, 80.

In the current arrangement, the first temporary retention includes one or more shear pins 78 disposed in the first plug element 70 and engaging adjacent the bore 62. In particular, a first retention ring 76 disposed in the bore 62 around the first plug element 70 engages the one or more shear pins 78. This first retention ring 76 is held longitudinally in the bore 62 by the coupling of the housing's end 63 to the tubing string (12). The first retention ring 76 has a shoulder 77 that engages an upper surface or end 72 of the first plug element 70 and retains the first plug element 70 longitudinally in an uphole direction in the bore 62. Alternative forms of retention could be used, such as pins disposed in the housing 60. However, use of the retention ring 76 facilitates assembly of the device 30 and helps maintain the integrity of the housing 60.

The second temporary retention includes one or more shear pins 88 disposed in the second plug element 80 and engaging a second retention ring 86 disposed in the bore 62. The second ring 86 is held axially in the bore 62 by interconnected (e.g., threaded) components 64, 66 of the housing 60. One of the interconnected components 66 of the housing 60 has a shoulder 68 that engages the second plug element 80 and retains the second plug 80 longitudinally in an uphole direction in the bore 62.

The first seal 75 includes one or more O-ring seals disposed externally about the first plug element 70 and disposed in the bore 62. These first seals 75 engage both the inside and outside surfaces of the first ring 76, which encapsulates the first plug element 70. The second seal 85 includes one or more O-ring seals disposed externally about the second plug 80 that engage inside the surface of the bore 62. As will be appreciated, a number of different seal arrangements could be used to isolate the chamber 65 in the bore 62 from surrounding fluids both uphole in the tubing string and downhole in the wellbore.

The plug elements 70, 80 are preferably composed of a material capable of withstanding loads. This material may be ceramic, metal, polymer, or the like, and the material may also be a composite of two or more materials. Preferably, the first plug element 70 is composed of a dissolvable material, and the uphole surface, end, or side 72 of the first plug element 70 preferably has a non-dissolvable coating, cover, or the like. The second plug element 80 is also preferably composed of a dissolvable material, and its downhole surface, end, or side 82 can preferably have a non-dissolvable coating, cover, or the like. The two plug elements 70, 80 coated only on the exposed sides 72, 82 and acting as boundaries of the space or chamber 65 do not dissolve until they are pumped out of the housing 60, which subsequently exposes the uncoated dissolvable material of the elements 70, 80 to the wellbore and various fluids. The chamber 65 can be an atmospheric chamber at a low pressure, although it may contain any suitable fluid not directed to dissolve the plugs 70, 80.

A number of dissolvable materials can be used for the plug elements 70, 80, such as those dissolvable materials typically used for deployed plugs, balls, or the like. In general, the dissolvable material can degrade in the wellbore environment overtime when exposed to temperatures, fluids, or other conditions. Generally speaking, the dissolvable material can include one or more of polystyrenes, elastomers, resins, adhesives, polyesters, polymides, thermoplastic polymers, thermosetting polymers, alloy non-composites, and various metallic materials to name just a few. Moreover, although referenced as being "dissolvable," the materials can dissolve, disintegrate, degrade, erode, or the like.

As noted above, the uphole end 72 of the first plug element 70 preferably has a non-dissolvable coating, cover, or the like. Any number of non-dissolvable materials can be used for the coating, cover, or the like. As one example, forms of coating involving powder coatings and epoxies, such as available from Terves, Inc., can be used. As noted above, each plug element 70, 80 can be coated on the externally-exposed sides or ends 72, 82 to prevent dissolution while in the place. Finally, the rings 76, 86 can be metallic, ceramic, polymer, plastic, composite, or any other material as will occur to those of skill in the art.

Figures 3A, 3B, 3C, 3D:
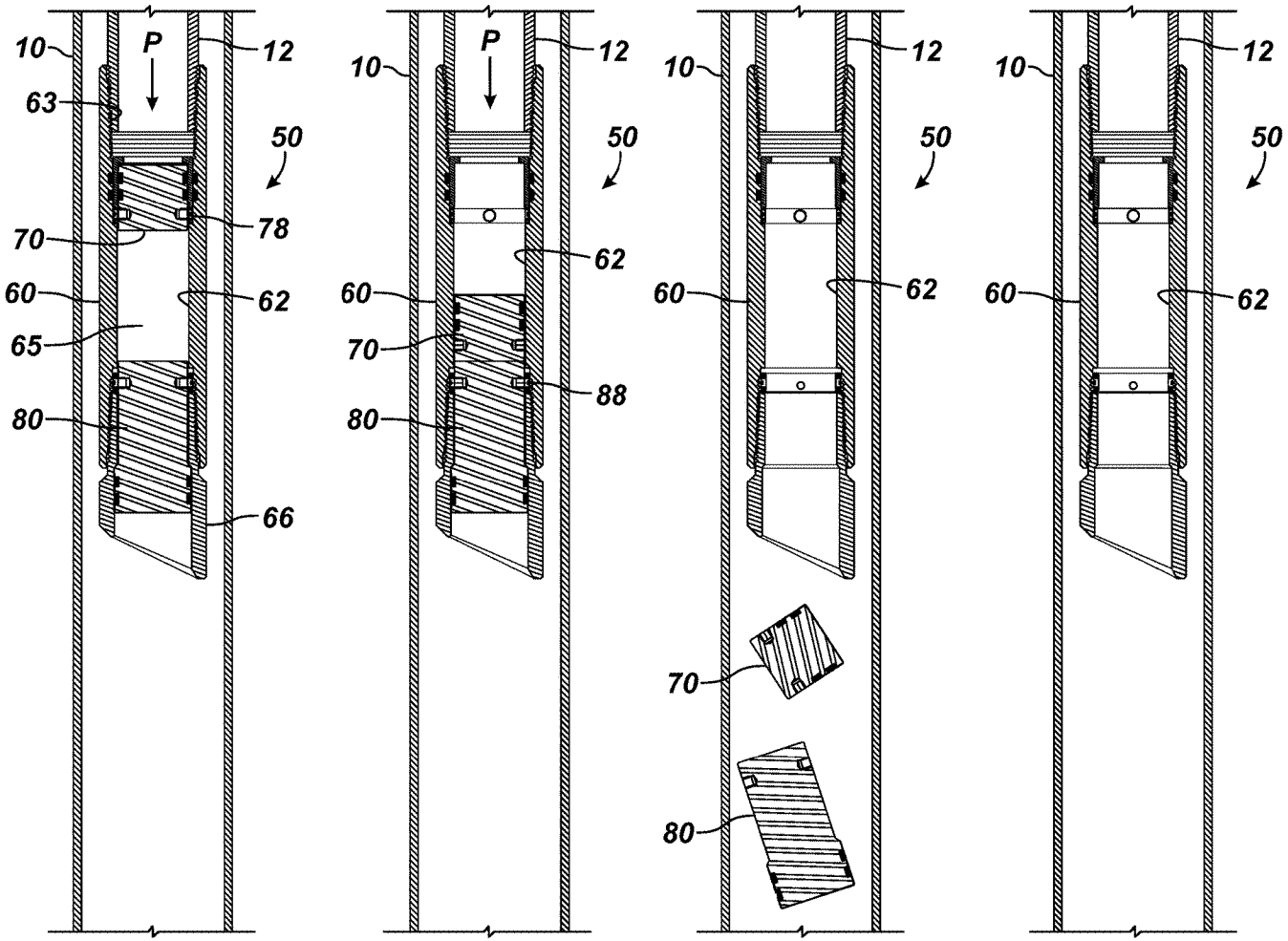
FIGS. 3A-3D illustrate the disclosed dual-barrier device during an exemplary form of use downhole.

With an understanding of the device, discussion now turns to its use in obstructing a tubing string in a well. In particular, FIG. 3A illustrates the temporary well isolation device 50 according to the present disclosure before triggering or release, and FIGS. 3B-3D illustrate the temporary well isolation device 50 upon triggering or release. As noted herein, the temporary well isolation device 50 operates generally to temporarily seal off a particular segment of the production tubing, or well zone, until being triggered.

For example, the wellbore isolation device 50 temporarily plugs the distal end of the tubing string 12 and serves as a temporary barrier or bridge plug for leak testing and/or for setting hydraulic packers or other tools. After the production string 12 is landed and the well is prepared for production, the internal plug elements 70, 80 are sheared out when appropriate differential pressure is applied to the tubing 12, leaving a full opening.

In particular, the uphole end 63 of the housing 60 in FIG. 3A is in fluid communication with the downhole tubing 12 above the housing 60. The second end 66 can be exposed to the wellbore 10, although it could likewise be in fluid communication with downhole tubing (not shown) below the housing 60. In the following description, directional terms, such as "above", "below", "upper", "lower", and so on, are used for convenience in referring to the accompanying drawings. Readers of skill in the art will recognize that such directional language refers to locations in downhole tubing either closer or further away from surface and that the various embodiments described herein may be utilized in various orientations, such as inclined, inverted, horizontal, vertical, without departing from the principles of the present invention.

In this plugged condition, the plug elements 70, 80 sealingly engaged in the bore 62 block fluid flow through the bore 62, which results in the plug elements 70, 80 bearing a load from fluid pressure both inside and outside the tubing 12. In this sense, the two dissolvable plugs 70, 80 are used as the boundaries of the housing 60 with the space between them forming an atmospheric chamber 65.

Once leak testing and/or hydraulic setting is complete, operators pump pressure P down the tubing string 12 to a predetermined threshold to eventually communicate the tubing (12) to the wellbore annulus. When the threshold is reached, the first temporary retention (e.g., 78) releases the first plug element 70 in the bore 62 in response to this application of uphole pressure P. The pressure P applied against the upper end 72 eventually shears the shear pins 78, and the first plug 70 can slide out of the retention ring 76 and into the closed space 65.

As shown in FIG. 3B, the applied pressure P pushes the first plug element 70 in the housing 60 so the applied pressure P can then act against the second plug element 80 when the first plug element 70 engages against it. Eventually, the second temporary retention (e.g., 88) releases the second plug element 80 in the bore 62 in response to the applied pressure P. As shown in FIG. 3C, the two dissolvable plug elements 70, 80 are then pumped out of the housing 60 and can enter the wellbore.

Once the plug elements 70, 80 are pumped out of the housing 60, they begin dissolving at their uncoated sides as a result of exposure to wellbore conditions. Finally, as shown in FIG. 3D, the tubing string 12 communicates with the full-bore 62 of the unplugged housing 60. The plug elements 70, 80 have dissolved, which prevents the possibility of them resealing in the tubing 12 or causing further issues in the well.

In the previous embodiments, the wellbore isolation device 50 has been used on the end of the tubing string 12, although in other embodiments the device 50 can be disposed elsewhere on the tubing string 12. For instance, the wellbore isolation device 50 of the present disclosure may disposed on the tubing string 12 downhole of a hydraulically-actuated tool, or features of the device 50 can be an integrated part of such a tool, such as a packer, a liner-top packer, a liner hanger, a pressure-activated sleeve, or other tool. Alternatively the temporary well isolation device 50 may be configured to be run on the tubing string 12 in the well independently of any other tool.

Figure 4:
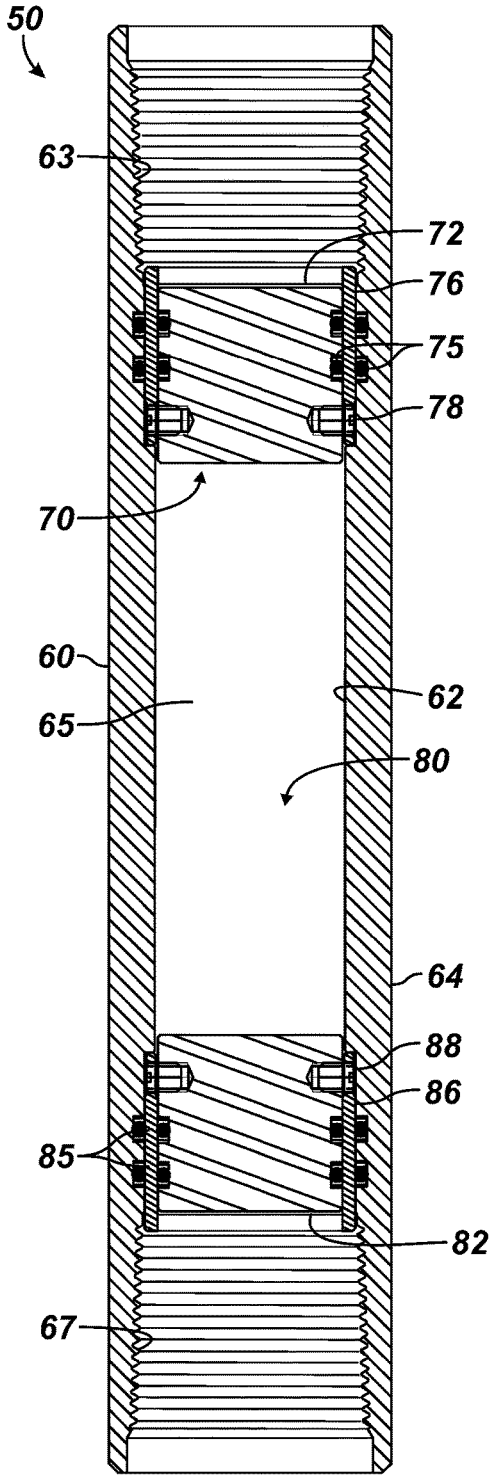
FIG. 4 illustrates a cross-sectional view of another dual-barrier wellbore isolation device according to the present disclosure.

As a brief example, FIG. 4 illustrates the wellbore isolation device 50 with a housing 60 configured to connect to tubing, tools, or the like at both ends. Like reference numerals are used for similar components as found in previous embodiments. The uphole end of the housing has thread 63 for connecting to tubing, tool, or other component (not shown). The downhole end of the housing 60 also has thread 67 for connecting to tubing, tool, or other component (not shown). The thread 63, 67 can be a box connection as shown or other type of connection. In this housing 60, the plug elements 70, 80 are symmetrically arranged on both sides of the space 65.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A wellbore isolation device for a tubing string in a well, the device comprising:

a housing disposed on the tubing string and defining a bore therethrough;

a first plug comprising a first dissolvable material, the first plug held in the bore by a first temporary retention and sealed in the bore with a first seal; and a second plug comprising a second dissolvable material, the second plug held in the bore at a space from the first plug by a second temporary retention and sealed in the bore with a second seal, the first and second seals sealing the space in the bore between the first and second plugs, wherein a first end of the first plug facing away from the space comprises a first non-dissolvable surface, and wherein a second end of the second plug facing away from the space comprises a second non-dissolvable surface.

2. The device of claim 1, wherein the housing is disposed on an end of the tubing string, is disposed downhole of a hydraulically-actuated tool, or is integrated as part of the hydraulically-actuated tool.

3. The device of claim 1, wherein the first temporary retention comprises one or more shear pins engaging adjacent the first plug and the bore; and wherein the first temporary retention comprises a first retention ring disposed in the bore around the first plug and engaging the one or more shear pins disposed in the first plug, the first retention ring being held longitudinally in the bore by coupling of the housing to the tubing string.

4. The device of claim 3, wherein the first retention ring comprises a shoulder engaging the first plug and retaining the first plug longitudinally in an uphole direction in the bore; and wherein the first seal comprise a pair of the first seal elements disposed on both sides of the first retention ring, one of the first seal elements sealing between the bore and the first retention ring, another of the first seal elements sealing between the first retention ring and the first plug.

5. The device of claim 1, wherein the second temporary retention comprises one or more shear pins disposed adjacent the second plug and the bore; and wherein the second temporary retention comprises a second retention ring disposed in the bore around the second plug and engaging the one or more shear pins disposed in the second plug, the second retention ring being held longitudinally in the bore by interconnected components of the housing.

6. The device of claim 5, wherein the second seal comprise a pair of the second seal elements disposed on both sides of the second retention ring, one of the second seal elements sealing between the bore and the second retention ring, another of the second seal element sealing between the second retention ring and the second plug.

7. The device of claim 5, wherein the housing comprises a shoulder engaging the second plug and retaining the second plug longitudinally in an uphole direction in the bore.

8. The device of claim 1, wherein the first temporary retention releases the first plug in the bore in response to application of an uphole pressure in the tubing string; and wherein the second temporary retention releases the second plug in the bore in response to the application of the uphole pressure after the release of the first plug.

9. The device of claim 1, wherein the first and second dissolvable materials are selected from the group consisting of a ceramic, a metal, a polymer, a composite, a polystyrene, an elastomer, a resin, an adhesive, a polyester, a polymide, a thermoplastic polymer, a thermosetting polymer, an alloy non-composite; and wherein the first and second non-dissolvable materials are selected from the group consisting of a coating, a cover, a powder coating, and an epoxy.

10. The device of claim 9, wherein the first plug comprises a dissolvable material; and wherein an uphole end of the first plug facing away from the space comprises a non-dissolvable surface; and wherein the second plug comprises a dissolvable material; and wherein a downhole end of the second plug facing away from the space comprises a non-dissolvable surface.

11. A method of isolating portion of a tubing string in a well, the method comprising not necessarily in sequence:

configuring first and second plugs of dissolvable material;

configuring at least one side of the first plug with non-dissolvable material;

temporarily retaining the first plug sealed in a bore of a housing for deploying on the tubing string downhole in the well;

temporarily retaining the second plug sealed in the bore of the housing at a space from the first plug and with the at least one first side of the first plug exposed away from the space; and configuring the temporary retention of the first and second plugs to release from the housing at least in response to an application of fluid pressure against the first plug.

12. The method of claim 11, further comprising configuring at least one second side of the second plug with non-dissolvable material; and wherein temporarily retaining the second plug comprises disposing the at least one second side of the second plug away from the space.

13. The method of claim 11, wherein configuring the at least one first side of the first plug with the non-dissolvable material comprises applying a coating of the non-dissolvable material on the at least one first side.

14. The method of claim 11, wherein temporarily retaining the first plug sealed in the bore of the housing comprises engaging one or more first shear pins adjacent the first plug and the bore by disposing the one or more first shear pins in the first plug, and disposing the one or more first shear pins in a first ring disposed about the first plug and holding the first ring longitudinally in the bore by coupling of the housing to the tubing string.

15. The method of claim 11, wherein temporarily retaining the second plug sealed in the bore of the housing comprises engaging one or more second shear pins adjacent the first plug and the bore by disposing the one or more second shear pins in the second plug, and disposing the one or more second shear pins in a second ring disposed about the second plug and holding the second ring longitudinally in the bore by interconnected components of the housing.

16. The method of claim 11, wherein configuring the temporary retention of the first and second plugs to release from the housing at least in response to the application of the fluid pressure against the first plug comprises:

configuring the temporary retention of the first plug to release in the bore in response to the application of the fluid pressure; and configuring the temporary retention of the second plug to release in the bore after the release of the first plug.

17. A method of isolating portion of a tubing string in a well, the method comprising not necessarily in sequence:

deploying a housing on the tubing string downhole in the well;

preventing fluid in the tubing string from dissolving a first dissolvable plug sealed in the housing with a first non-dissolvable side of the first dissolvable plug exposed to the tubing string;

preventing the fluid in the tubing string from dissolving a second dissolvable plug sealed in the housing at a space downhole from the first dissolvable plug;

preventing at least temporarily displacement of the first and second dissolvable plugs in the bore; and releasing the first and second plugs to displace in the housing by applying uphole fluid pressure against the first plug.

18. The method of claim 17, wherein deploying the housing on the tubing string downhole in the well comprises deploying the housing on an end of the tubing string, downhole of a hydraulically-actuated tool, or integrated as part of the hydraulically-actuated tool.

19. The method of claim 17, further comprising preventing fluid in the well from dissolving the second dissolvable plug sealed in the housing with a second non-dissolvable side of the second dissolvable plug exposed away from the space; and wherein preventing at least temporarily displacement of the first dissolvable plug in the bore comprises temporarily retaining the first dissolvable plug sealed in the bore of the housing with one or more first shear pins.

20. The method of claim 17, wherein preventing at least temporarily displacement of the second dissolvable plug in the bore comprises temporarily retaining the second dissolvable plug sealed in the bore of the housing with one or more second shear pins.

21. The method of claim 17, wherein releasing the first and second plugs to displace in the housing by applying the uphole fluid pressure against the first dissolvable plug comprises:

releasing temporary retention of the first plug in the bore in response to the application of the uphole fluid pressure; and releasing temporary retention of the second plug in the bore after the release of the first plug.

22. A wellbore isolation device for a tubing string in a well, the device comprising:

a housing disposed on the tubing string and defining a bore therethrough;

a first plug held in the bore by a first temporary retention and sealed in the bore with a first seal; and a second plug held in the bore at a space from the first plug by a second temporary retention and sealed in the bore with a second seal, the first and second seals sealing the space in the bore between the first and second plugs, wherein at least one of the first and second temporary retentions comprises:

one or more shear pins engaging adjacent the respective one of the first and second plugs and the bore; and a retention ring held longitudinally in the bore around the respective plug and engaging the one or more shear pins disposed in the respective plug.

23. The device of claim 22, wherein the retention ring comprises a shoulder engaging the respective plug and retaining the respective plug longitudinally in one direction in the bore.

24. The device of claim 22, wherein the bore of the housing defines a shoulder longitudinally holding the retention ring in one direction in the bore; and wherein connection of the housing to another component longitudinally holds the retention ring in an opposite direction in the bore.

25. The device of claim 22, wherein the respective seal comprise a pair of seal elements disposed on both sides of the retention ring, one of the seal elements sealing between the bore and the retention ring, another of the seal elements sealing between the retention ring and the respective plug.

26. The device of claim 22, wherein the housing comprises a shoulder engaging the respective plug and retaining the respective plug longitudinally in one direction in the bore.

27. The device of claim 22, wherein the first temporary retention releases the first plug in the bore in response to application of an uphole pressure in the tubing string; and wherein the second temporary retention releases the second plug in the bore in response to the application of the uphole pressure after the release of the first plug.

* * * * *